United States Patent [19]

Lamarque

[11] 4,252,988

[45] Feb. 24, 1981

[54] ELECTROSLAG REMELTING PLANT

[75] Inventor: Gabriel Lamarque, Paris, France

[73] Assignee: Vereinigte Edelstahlwerke Aktiengesellschaft, Vienna, Austria

[21] Appl. No.: 22,516

[22] Filed: Mar. 21, 1979

[30] Foreign Application Priority Data

Mar. 22, 1978 [FR] France ..... 78 08270

[51] Int. Cl.[3] ..... H05B 7/11

[52] U.S. Cl. ..... 13/9 ES

[58] Field of Search ..... 13/9, 9 ES, 14–17, 13/10

[56] References Cited

U.S. PATENT DOCUMENTS

| | | | |
|---|---|---|---|
| 2,944,099 | 7/1960 | Sernitz et al. | 13/10 |
| 3,781,448 | 12/1973 | Holzgruber et al. | 13/9 ES |

*Primary Examiner*—Roy N. Envall, Jr.

*Attorney, Agent, or Firm*—Brumbaugh, Graves, Donohue & Raymond

[57] ABSTRACT

In an electroslag remelting plant including at least one electrode arranged in a pivotable electrode car and in which each electrode car is connectable by an electrically conducting connection to a source of electric current, the electrically conducting connection is composed of two parts separable and connectable at the height of the pivotable electrode car by a pivotal movement of the same.

5 Claims, 3 Drawing Figures

ELECTROSLAG REMELTING PLANT

BACKGROUND OF THE INVENTION

The invention relates to an electroslag remelting plant comrising at least one electrode arranged in a pivotable electrode car, the electrode car being connectable to a source of electric current by means of an electrically conducting connection.

In recent years the requirement for an increase in the magnitude of the ingots produced in electroslag remelting plants (ESR-plants) has come up, thus resulting in an enlargement of the electrodes used in such plants. The increase in the diameter and the weight of the ingots and electrodes necessitates a considerable excessive proportional increase in the current required for the remelting process. In particular an ingot with a diameter of, for instance, 1000 mm requires a current of 20 kA, while a current of 30 kA will be necessary for an ingot having a diameter of 1200mm. Since the current increases to a larger extent than the diameter of the ingot, the inductive losses in the secondary circuit and the induction losses in the carrying construction of the ESR-plant also increases to a larger extent than its useful output, i.e. the efficiency of the output into the slag is reduced.

In order to remelt several elctrodes into a single block, it is necessary to effect an exchange of electrodes, for instance by means of a pivotable electrode car. With known ESR-plants, taking into consideration this requirement, there results an increase in the length and the area of the secondary electric circuit and thus an increase in its impedance.

The production of large ingots therefore necessitates first an increase of the specific energy consumption (kWh/t), and second a reduction of the efficiency factor of the secondary electric circuit, whereby a retroactive an overload of the electric network and an instability of the efficiency control is caused. Pivotable electrode cars furthermore cause a distortion of the current supply cable during the electrode exchanging processes, an additional mechanical strain on the current supply cables thus being caused.

The invention aims at avoiding these disadvantages and difficulties and has as its object to provide an electroslag remelting plant of the intitially-described kind in which the impedance of the secondary electric circuit and its magnetic effect will be reduced, and in which no distortion of the current supply cables during the exchange of electrodes will occur. The length of the current supply cable as far as to the elelctrode is also to be reduced.

These objects are achieved according to the invention in that the electrically conducting connection comprises two parts that are separable and connectable at the height of the electrode car by a pivotal movement of the same.

According to a preferred embodiment, the two parts are connectable by means of a clamping device, wherein the clamping device advantageously is designed as a tong whose cheeks are actuable by means of hydraulic or compressed-air cylinders.

According to another embodiment, the clamping device suitably is designed as a coupling.

A preferred embodiment of the electroslag remelting plant has two electrode cars, each being movable by means of a slide piece along a guide and pivotable about the guide. On each of the cars there is fastened an electrode carrier comprising an electrode gripping tong. This embodiment is improved in that for each electrode car, one part of the connection is designed as a flexible current supply cable secured by a console that is carried by the slide piece of the electrode car. A clamping device is fastened at the end of the current cable. The other part of the connection is rigidly fastened to the pivotable electrode car and is pivotable with the same. One end of this part of the connection is connected to the electrode gripping tong, and the other end is free and is designed so as to be insertable into the clamping device.

According to the invention, the distortion of the electrically conducting connection is avoided during the exchange of electrodes. The flexible connection only has to compensate for the path of the car. The connections of the secondary electric circuit for supplying and conducting away the current, are arranged closer to one another and can possibly be arranged one above the other.

BRIEF DESCRIPTION OF THE DRAWING

The invention will now be explained in more detail by way of two embodiments illustrated in the accompanying drawings, wherein.

DESCRIPTION OF ILLUSTRATED EMBODIMENTS

Figure 1:
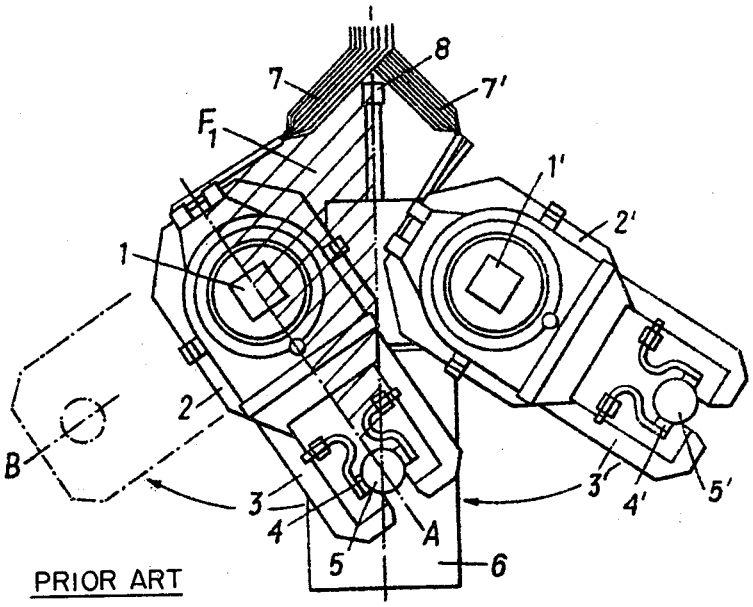
FIG. 1 shows a top view of a prior art electroslag remelting plant; and, FIGS. 2 and 3 represent plants according to the invention in illustrations analogous to FIG. 1, FIG. 3 being drawn on a larger scale.

According to the known type of plant illustrated in FIG. 1, two guide posts 1, 1' are provided, along which electrode cars 2, 2' are respectively displaceable. Each electrode car 2, 2' is composed of a slide piece (slide rail) sliding along the respective guide post 1, 1' and an electrode carrier 3, 3' having an electrode clamping device 4, 4' conducting the current to electrode 5, 5'. Each of the two electrode cars 2, 2' can be pivoted by about 90° about the axis of its guide post 1, 1', from a working position A, which is illustrated in continuous line in FIG. 1 for the electrode car 1, into a charging position B, which is entered in FIG. 1 with a dot-and-dash line. In the charging position, the elongation piece of the electode which has already been remelted, is drawn back and replaced by a new electrode. The plant furthermore comprises a car 6 which carries the ingot during the remelting process. A mould car not illustrated is also displaceably guided along one of the guide posts 1, 1'. A bundle of flexible current supply cables 7, 7' forms a connection between the current supply source and each of the electrode cars 2, 2'. The electric circuit is closed via the electrode (when pivoted into the working position), the slag, and a rigid connection 8 arranged on the car 6.

After producing a current flow, remelting of the electrode takes place, during which the electrode is displaced in the vertical direction along one of the guide posts 1, 1'. The respective flexible current supply cables 7, 7' which are fastened to the pertaining electrode cars 2, 2' are moved together with the electrodes. At the end of the remelting process the current flow is interrupted and the electrode car is pivoted with the elongation piece from the working position A into the charging position B.

This known plant has two basic disadvantages, namely a magnetic influence that is strong in compliance with the secondary circuit (corresponding to the hatched field $F_1$ of FIG. 1) as well as a distortion of the current supply cables during pivoting of the electrode car.

Figure 2:
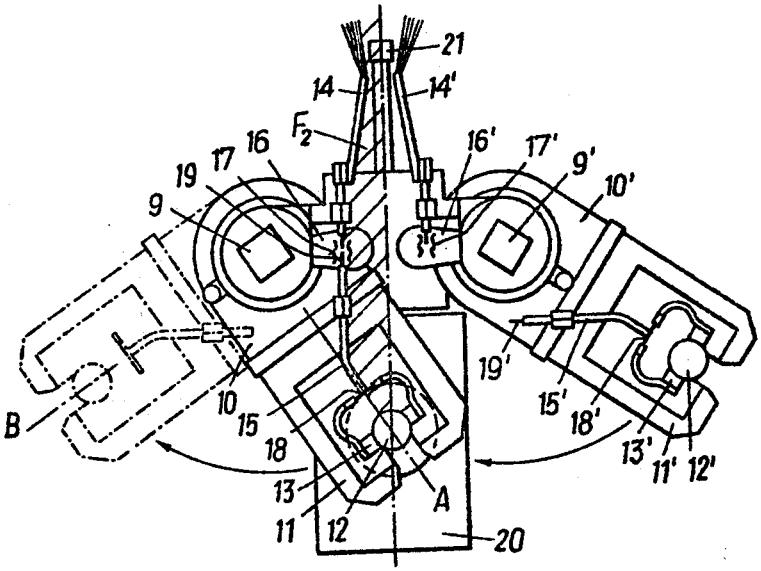
PRIOR ART FIG. 2

In FIG. 2, which shows a schematically represented top view of a plant according to the invention, two posts 9, 9' serve as guides along which electrode cars 10, 10' are each displaceably guided, respectively. Each of the two electrode cars 10, 10' is composed of a slide piece (slide rail) sliding along the guide post, and an electrode carrier 11, 11' having an electrode gripping tong 13, 13' securing electrode 12, 12'. The electrically conducting connection from the current source to each electrode carrier 11, 11', according to the invention, comprises two parts 14, 14' and 15, 15'. One part 14, 14' (i.e. part 14 for the electrode carrier 11) and 14' for the electrode carrier 11', respectively) is designed as a flexible cooled current supply cable and is secured by a console 16, 16' arranged on the slide rail of the electrode car 10, 10'. At the end of these current supply cables 14, 14' clamping devices 17, 17' are each securely, mounted on the console. The clamping devices 17, 17' may be formed of a tong or another equiavalent connecting piece, for instance a coupling.

The second part 15, 15' of the electrically conducting connection is rigidly fastened to the pivotable electrode carrier 11, 11' and is pivotable together with it. One end 18, 18' of each second part of the connection is connected to the electrode gripping tong 13, 13', respectively; the other end 19, 19' is free and designed so as to fit into the respective clamping device 17, 17'. The electric circuit is closed when the electrode is pivoted into the working position A, the slag, the car 20 carrying the ingot, and the connection 21 arranged on the ingot-carrying car 20.

Figure 3:
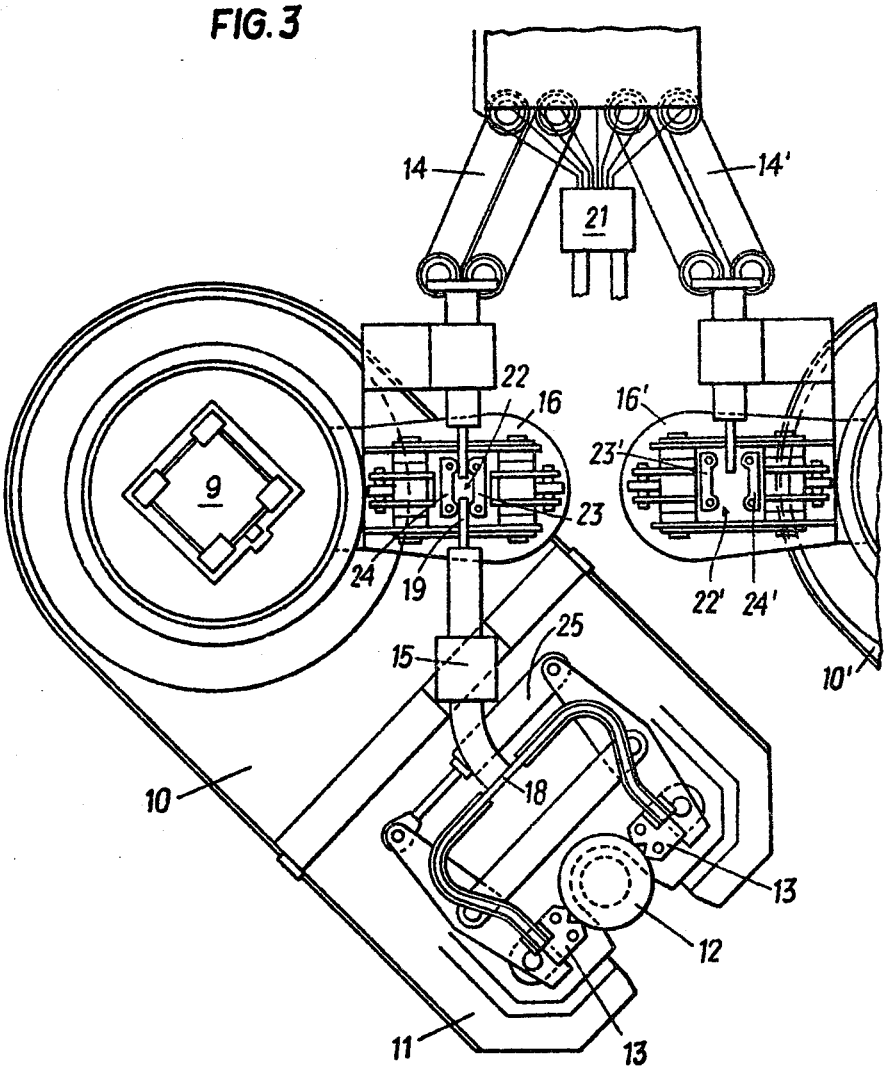

In the embodiment illustrated in FIG. 3, in which the same parts are denoted by the same reference numerals, each clamping device is designed as a tong 22, 22' whose cheeks 23, 24 can be actuated by pressure medium cylinders. The electrode gripping tong, as is known, is actuable also by a pressure-medium cylinder 25, 25'.

At the onset of remelting, one of the electrode carriers 11, 11' is pivoted from the charging position B into the working position A, the free end 19, 19' of the second part 15, 15' of the connection being introduced into the clamping device towards the end of the pivoting process. During this movement, the cooled flexible current supply cables 14, 14' will not be distorted, in contrast to known ESR-plants. Subsequent to the pivotal movement, the pressure-medium cylinders moving the tong cheeks 23, 24 are actuated and the free ends 19, 19' of the second part 15, 15', respectively, of the connection will be connected to the first one. This procedure takes place in the reverse direction, when an electrode carrier 11, 11' is pivoted out, for instance for the purpose of an electrode exchange.

As can be seen particularly from FIG. 2, the plant according to the invention makes possible an essential reduction of the impedance and of the magnetic influence, as can be seen from a comparison of the hatched field $F_2$ of FIG. 2 with the hatched field $F_1$ of FIG. 1.

What I claim is:

1. In an electroslag remelting plant of the type including at least one electrode, at least one electrode car capable of pivotal movement and adapted to carry said at least one electrode, a source of electric current, an electrically conducting connection means adapted to connect said at least one electrode car to said source of electric current, the improvement which is characterized in that said electrically conducting connection means comprises:

a first electrically conducting connection member;

a second electrically conducting connection member adapted to be separated from and connected to the first connection member at the height of the electrode car by pivotal movement of said electrode car; and clamping means mounted at and attached to said first connection means for connecting said first connection member to said second connection member, said clamping means being a tong clamping means having cheeks and a pressure cylinder acting on said cheeks so as to bring them together or separate them, an end of said second connection member being inserted between the cheeks of the tong clamping means by the pivotal movement of said electrode car.

2. An electroslag remelting plant as set forth in claim 1, wherein said cylinder means are hydraulic cylinders.

3. An electroslag remelting plant as set forth in claim 1, wherein said cylinder means are compressed-air cylinders.

4. An electroslag remelting plant as set forth in claim 1, wherein said clamping means are designed as a coupling.

5. An electroslag remelting plant as set forth in claim 1 wherein there are two electrode cars and said first connection member is a flexible current supply cable, and wherein the plant further includes a guide and a slide piece for each electrode car, each electrode car being adapted to be moved along said guide by said slide piece and pivoted about said guide;

an electrode carrier fastened to each electrode car with an electrode gripping tong being provided on said electrode carrier; and a console carried by said slide piece of each electrode car said first connection member for each electrode car being held by said console of the pertaining car, said clamping means pertaining to each car being fastened to one end of said flexible current supply cable, said second connection member of each car being rigidly connected to the pertaining electrode car and adapted to be pivoted with said electrode car, one end of said second connection member being attached to the pertaining electrode gripping tong, the other end of said second connection member being free and adapted to be inserted into said clamping means by the pivotal movement of said electrode car.

* * * * *

UNITED STATES PATENT AND TRADEMARK OFFICE

CERTIFICATE OF CORRECTION

PATENT NO. : 4,252,988

DATED : Feb. 24, 1981

INVENTOR(S) : Gabriel Lamarque

It is certified that error appears in the above—identified patent and that said Letters Patent is hereby corrected as shown below:

First page, Item 73, after "Aktiengesellschaft" insert --(VEW)--. Col. 1, line 6, "comrising" should read --comprising--; line 24, "increases" should read --increase--; following line 43, insert the heading --SUMMARY OF THE INVENTION--. Col. 2, line 22, "DRAWING" should read --DRAWINGS--; line 31, "ILLUSTRATED" should read --ILLUSTRATIVE--. Col. 3, line 18, "11)" should read --11--; line 23, "securely, mounted" should read --securely mounted--; line 25, "equiavalent" should read --equivalent--;

Col. 4, line 49, "car said" should read --car, said--.

Signed and Sealed this

*Seventh* Day of *July 1981*

[SEAL]

*Attest:*

RENE D. TEGTMEYER

*Attesting Officer*

*Acting Commissioner of Patents and Trademarks*